United States Patent [19]

Garcia De Couto

[11] Patent Number: 5,031,250

[45] Date of Patent: Jul. 16, 1991

[54] MECHANISM FOR FILLING AND DISCHARGING A TOILET WATER TANK

[76] Inventor: Manuel Garcia De Couto, Calle Tepuy, Residencia Trigal Apto. 9-A Parque Humboldt, Caracas, Venezuela, 9791993

[21] Appl. No.: 183,694

[22] Filed: Apr. 19, 1988

Related U.S. Application Data

[63] Continuation-in-part of Ser. No. 061,132, Jun. 10, 1987, Pat. No. 4,791,689.

[51] Int. Cl.[5] ..... E03D 1/36; E03D 5/09

[52] U.S. Cl. ..... 4/366; 4/395; 4/412; 137/410; 137/420; 137/430; 137/614.2

[58] Field of Search ..... 4/366, 367, 380, 382, 4/387, 395, 396, 405, 412, 413; 137/410, 420, 430, 533.19, 614.2, 532, 533, 533.17, 533.21, 533.23, 534

[56] References Cited

U.S. PATENT DOCUMENTS

| | | | |
|---|---|---|---|
| 1,476,985 | 12/1923 | Kollberg | 137/534 |
| 1,605,939 | 11/1926 | Haas | 4/412 X |
| 2,002,783 | 5/1935 | Long | 137/533.19 |
| 2,229,823 | 1/1941 | Sharp | 137/533.23 |
| 2,559,046 | 7/1951 | Peters et al. | 137/448 X |
| 2,608,991 | 9/1952 | Crockett | 137/437 X |
| 3,398,927 | 8/1968 | Rüter | 137/426 X |
| 3,421,546 | 1/1969 | Jennings et al. | 137/523 |
| 3,428,028 | 2/1969 | Hart | 137/410 |
| 3,775,778 | 12/1973 | Lee | 4/412 X |
| 3,982,557 | 9/1976 | Acevedo | 137/441 |
| 4,391,295 | 7/1983 | Stipe | 137/522 |
| 4,402,343 | 9/1983 | Thompson et al. | 137/614.2 |
| 4,765,363 | 8/1988 | Pi-Yu | 137/414 |

FOREIGN PATENT DOCUMENTS

| | | | |
|---|---|---|---|
| 136253 | 6/1947 | Australia | 137/410 |
| 218347 | 1/1958 | Australia | 137/410 |
| 912647 | 4/1954 | Fed. Rep. of Germany | 137/533.17 |
| 58-200867 | 11/1983 | Japan | 137/532 |
| 1051353 | 10/1983 | U.S.S.R. | 137/532 |
| 638003 | 5/1950 | United Kingdom | 137/532 |

*Primary Examiner*—Henry J. Recla
*Assistant Examiner*—Robert M. Fetsuga
*Attorney, Agent, or Firm*—Ladas & Parry

[57] ABSTRACT

The mechanism comprises an inlet valve assembly which admits water into a toilet tank under the control of a valve plug mounted on the end of a vertical axle having a float on its upper end. The valve plug is unseated, to admit water, when the axle is tilted, and the plug is pulled into seated position by the float when the tank is filled. A drainage buoy, in cooperation with a buoy base, allows discharge of water from the tank when the buoy is pulled from the base. Pull chains are used, from a toilet handle, to tilt the axle and pull the buoy. The inlet valve includes a water pressure reducer, and a non-return valve assembly to prevent return of water to the water supply in the event of a loss of water supply pressure.

2 Claims, 8 Drawing Sheets

MECHANISM FOR FILLING AND DISCHARGING A TOILET WATER TANK

This application is a continuation-in-part of application Ser. No. 061,132 filed June 10, 1987, now U.S. Pat. No. 4,791,689.

BACKGROUND OF THE INVENTION

The invention relates to a mechanism for filling and discharging a water tank of a toilet for flushing its toilet bowl.

The present invention provides improvements in a known toilet tank described in U.S. Pat. No. 4,791,689. The known mechanism and its general operation are described as follows.

A light manual pressure on a command handle on the outside of a toilet tank tilts a connected command lever in the toilet tank. The command lever is connected to a drainage buoy in a buoy base by a pulling chain to pull the drainage buoy from the buoy base when the command lever is tilted, whereupon the drainage buoy floats until the buoy base releases all the water from the tank by discharge into the toilet bowl. The same tilting action of the command lever also tilts an axle engaged by the command lever, which opens a valve on one end of the axle to allow new water to flow into the toilet tank. The discharge of water from the toilet tank is completed when there is insufficient water to float the drainage buoy and it settles down, by gravity, back into the buoy base, to close it again and stop the discharge of water, thereby allowing the toilet tank to refill with the new water from the valve on the axle. The pressure of the incoming water on the drainage buoy prevents its floating off the buoy base, thereby maintaining the base closed until the buoy is pulled therefrom by the command lever. The filling continues until the rise of the water level floats an axle floater on the opposite end of the axle from the valve sufficiently to put the axle in a vertical position and pull it vertically upwards. This closes the valve, and the tank is then full for another discharge operation. A pressure reducer at the valve can reduce the pressure of the water let into the tank if the water flows in at too high a pressure.

SUMMARY OF THE INVENTION

The present invention comprises a mechanism of the aforementioned type for use with a toilet tank, wherein, in one embodiment, the connecting linkage between the command lever and the discharge buoy and the valve controlling axle comprises a pair of chains each having one end connected to the command lever and the other end connected to each of the discharge buoy and the axle, respectively.

In another embodiment of the invention, a non-return valve is included within the water inlet valve for preventing discharge of water from the tank through the inlet valve upon a failure of inlet water pressure.

DETAILED DESCRIPTION

The earlier description of the operation of the mechanism shown in the aforementioned U.S. Pat. No. 4,791,689 applies generally to the operation of the mechanism of the present invention. Such mechanism is now described. It consists of the following parts, all of which are shown in FIGS. 1 and 2:

Command Handle 1,
Command Lever 2,
Pulling Chains 3A and 3B,
Drainage Buoy 4,
Buoy Base 5,
Valve Base 6,
Valve 7,
Umbrella-Cap 8,
Axle 9,
Axle Floater 10,
Pressure Reducer 11, and
Non-return Valve 12 and Washer 13.

The command handle 1 (FIGS. 1 and 2) controls the operation of the mechanism. The handle is operated (tilted), typically, manually. It has a hollow suitable to house and anchor an end 2-C of a command lever 2 which projects through the toilet tank 2.

Figure 1:
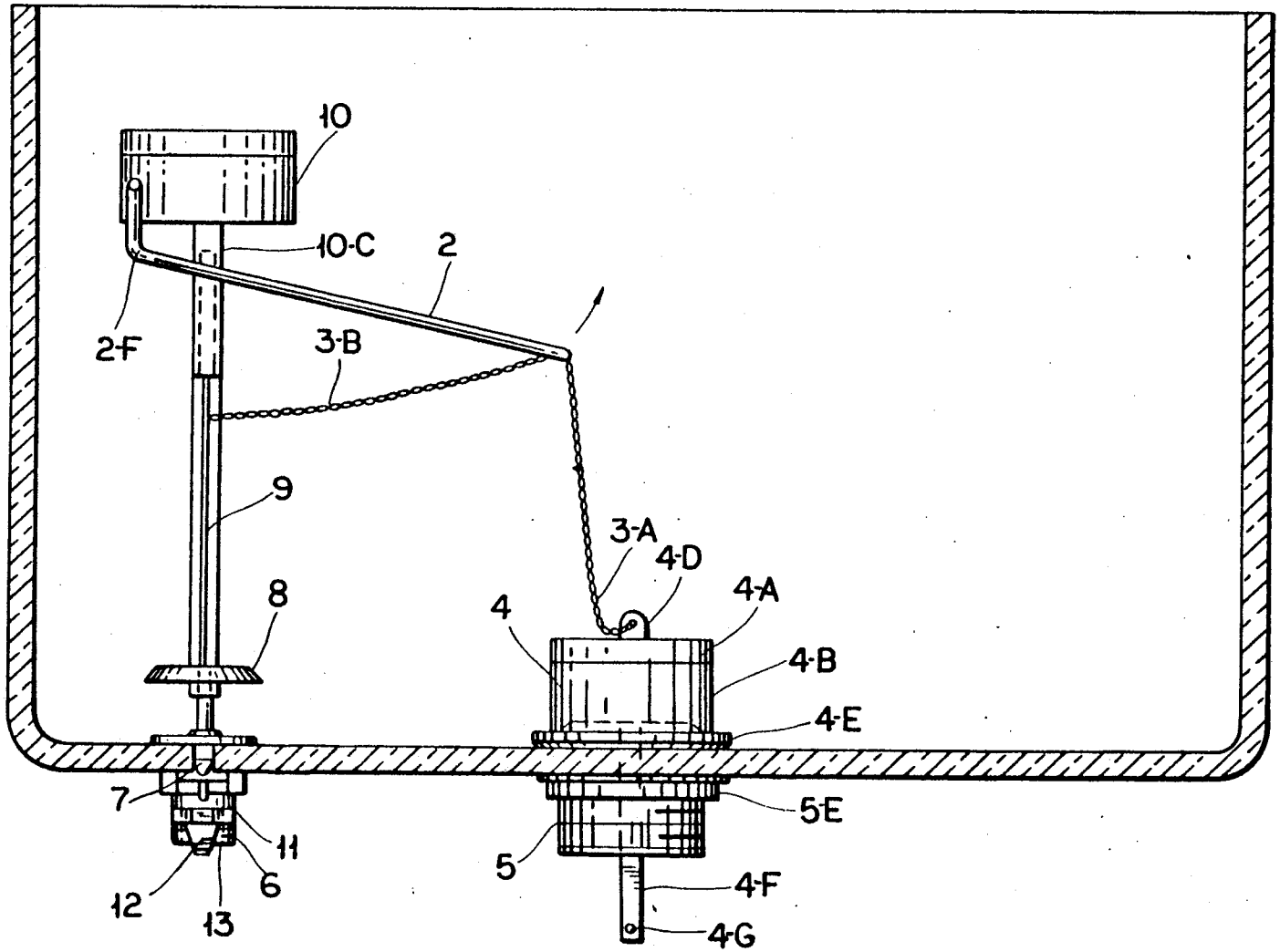
FIG. 1 is a front elevation, partly broken away, of a mechanism according to this invention affixed to a toilet tank.
Figure 2:
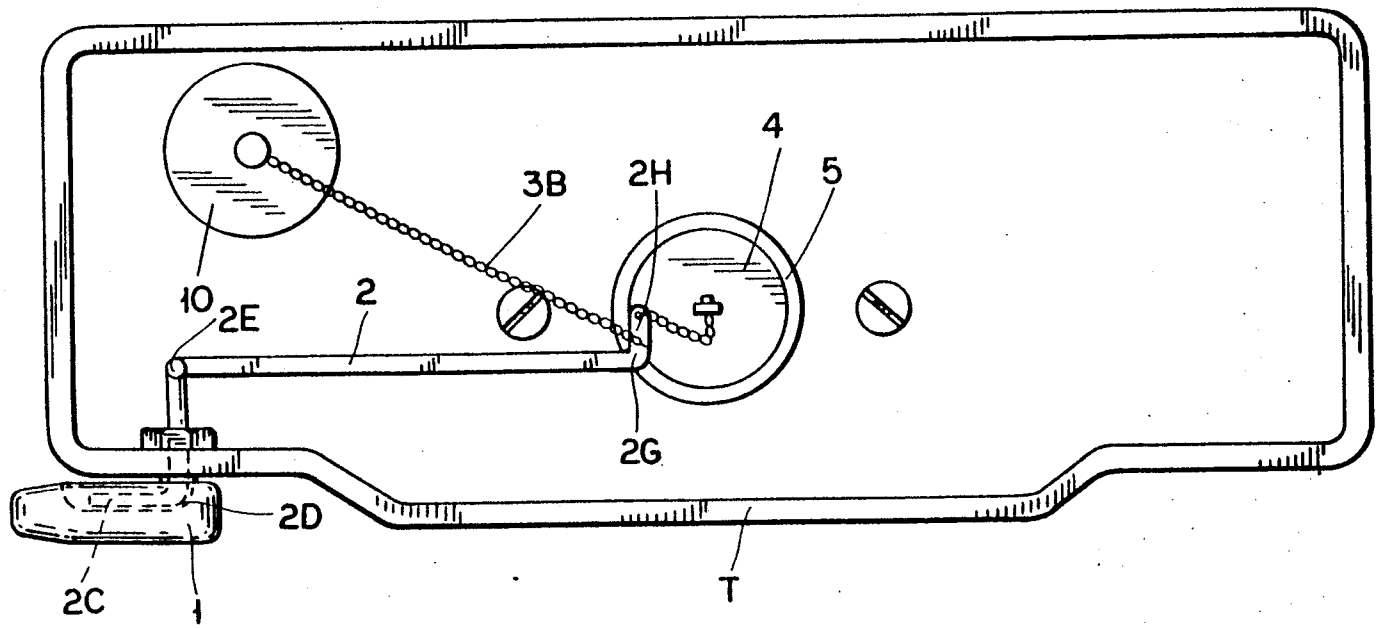
FIG. 2 is a top plan view of the toilet tank and mechanism of FIG. 1.

The command lever 2 is a rod that has four bends which give it the particular, irregular shape shown in FIGS. 1 and 2 of the drawing. Starting from its end 2-C attached to the command handle 1, a first bend 2-D turns it horizontally for entering the toilet tank T from its coupling within the hollow of the handle. A second bend 2-E turns it from horizontal to vertical inside the tank. A third bend 2-F, slightly over 90°, turns it from vertical to slightly downwardly inclined. A fourth bend 2-G finally terminates it in a straight horizontal length 2-H having two holes therethrough for the attachment of two pulling chains 3A and 3B.

The pulling chains 3A and 3B are respectively attached to a drainage buoy 4 and to a water valve inlet controlling axle 9. When the command handle 1 is turned counterclockwise, it correspondingly tilts the connected command lever 2, as shown by the arrow in FIG. 1, to pull the pulling chains 3A and 3B to pull the drainage buoy 4 upwards and to tilt the axle 9 to the right (as viewed in FIG. 1).

The use of the two pulling chains is an improvement over the command handle linkage shown in U.S. Pat. No. 4,791,689 which employs a command lever which is somewhat more complex (having five bends) and expensive than the one used herein.

The drainage buoy 4 (FIG. 1) is a floatable assembly. It has a cylindrical shape and primarily consists of an upper cap 4-A on a lower main body 4-B, which is cup shaped to define an internal chamber. The coupling of these parts is a fixed, permanent watertight closure to keep the internal chamber free of water. At the outer center of the upper cap is a projection 4-D with an orifice to hold the pulling chain 3A. Around the bottom end of the lower main body is a continuous, triangular-section flange 4-E with a conicity coinciding with an uppermost seat 5-A (described hereinafter) on the buoy base 5 to secure a watertight closure between these parts while in the closed position shown in FIG. 1. A rod-shaped axle guide 4-F projects from the center of the bottom end of the lower main body 4-B, the guide having a hole 4-G through its lower end through which a pin-butt (not shown) is passed to keep the drainage buoy 4 from slipping out of its operating place on the buoy base when pulled from its seat thereon by the pulling chain 3A and allowed to float.

Figure 5:
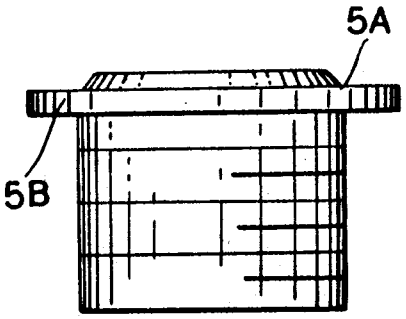
FIG. 5 is a side view of the buoy shown in FIGS. 3 and 4.
Figure 4:
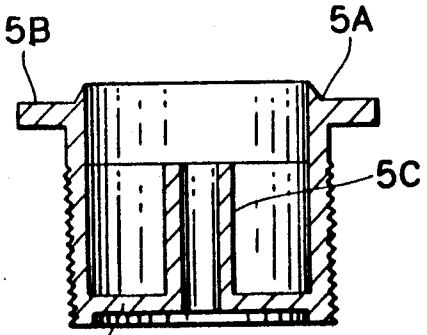
FIG. 4 is a cross-sectional view taken along line 4—4 of FIG. 3.
Figure 3:
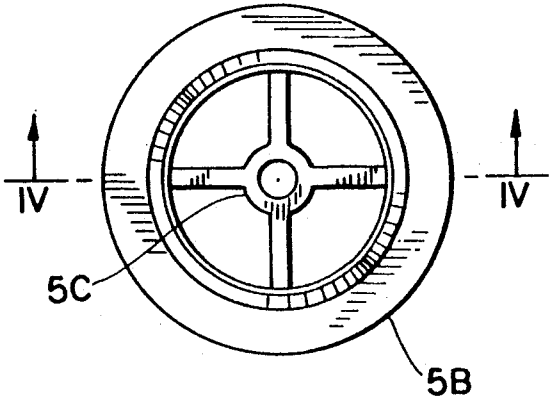
FIG. 3 is an enlarged top plan view of a buoy base shown in FIG. 1.

The buoy base 5 (FIGS. 3–5) is a generally cylindrical, hollow part that is fastened onto the bottom of the toilet tank T at its point of discharge. The buoy base has lower, external threading, so that it can be held in place with a regular nut 5-E (FIG. 1). Its upper end is provided with an external, surrounding, salient head 5-B, which has a seat 5-A for the drainage buoy and provides a circumferential fixation butt therefor. Its bottom has a central cylindrical guidecase 5-C, which is fixed to the rest of the buoy base by means of radial projections 5-D. This guide-case serves to guide the vertical sliding of the axle guide 4-F.

Figure 7:
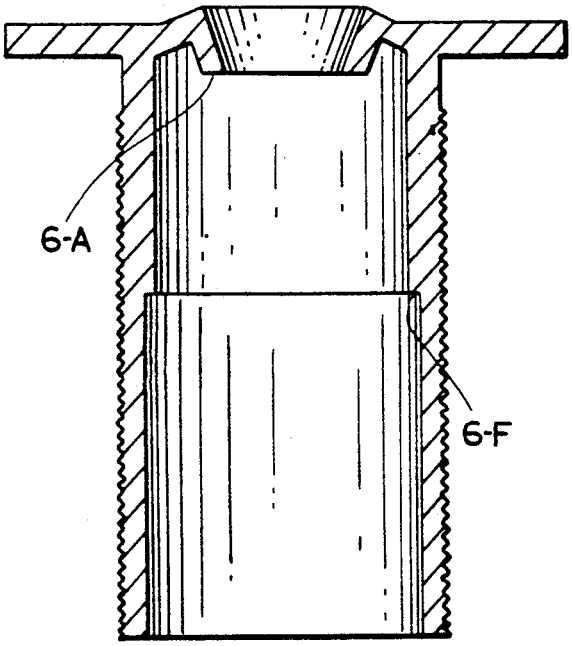
FIG. 7 is a cross-sectional view taken along line 7—7 of FIG. 6.
Figure 8:
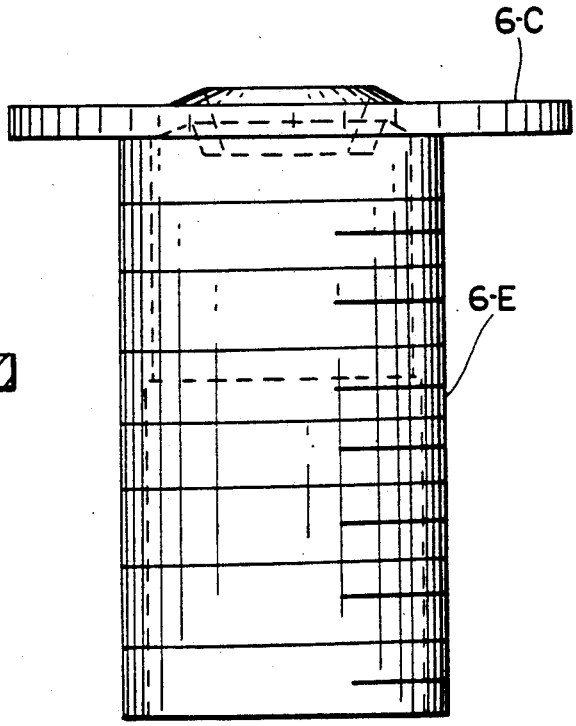
FIG. 8 is a side view of the valve base portion shown in FIGS. 6 and 7.
Figure 6:
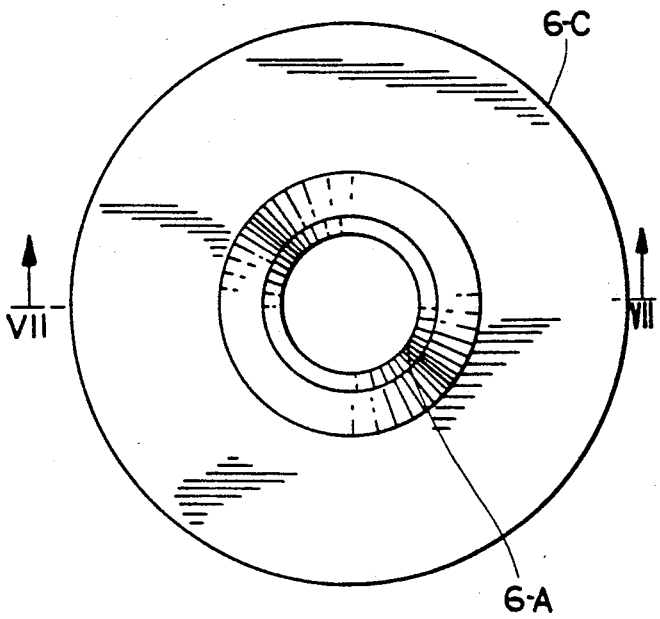
FIG. 6 is an enlarged top plan view of an inlet valve base portion shown in FIG. 1.
Figure 10:
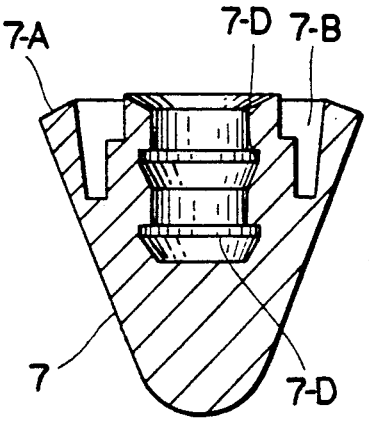
FIG. 10 is a cross-sectional view taken along line 10—10 of FIG. 9.

The valve base 6 (FIGS. 6–8) is another cylindrical, hollow part that is fastened (FIG. 1) to the bottom of the toilet tank T, in this case at its point of water inlet. The valve base is also provided with external, lower threading 6-E, so that it may be held in place with a regular nut. Its upper end is also provided with an external, salient, surrounding head 6-C, which serves as a seat and fixation butt. For its seat function, the central portion of its upper end is substantially a truncated cone having a lowermost smaller circular base for producing a seat ring 6-A for a rounded end 7-A (FIG. 10) of a valve 7 described hereinafter. The lower end threading on the valve base 6 is also appropriate for connection to a water supply pipe (not shown).

Within the cylindrical sleeve of the valve base 6 there is a change in internal diameter providing a stop 6-F to control the movement of a pressure reducer described hereinafter.

Figure 24:
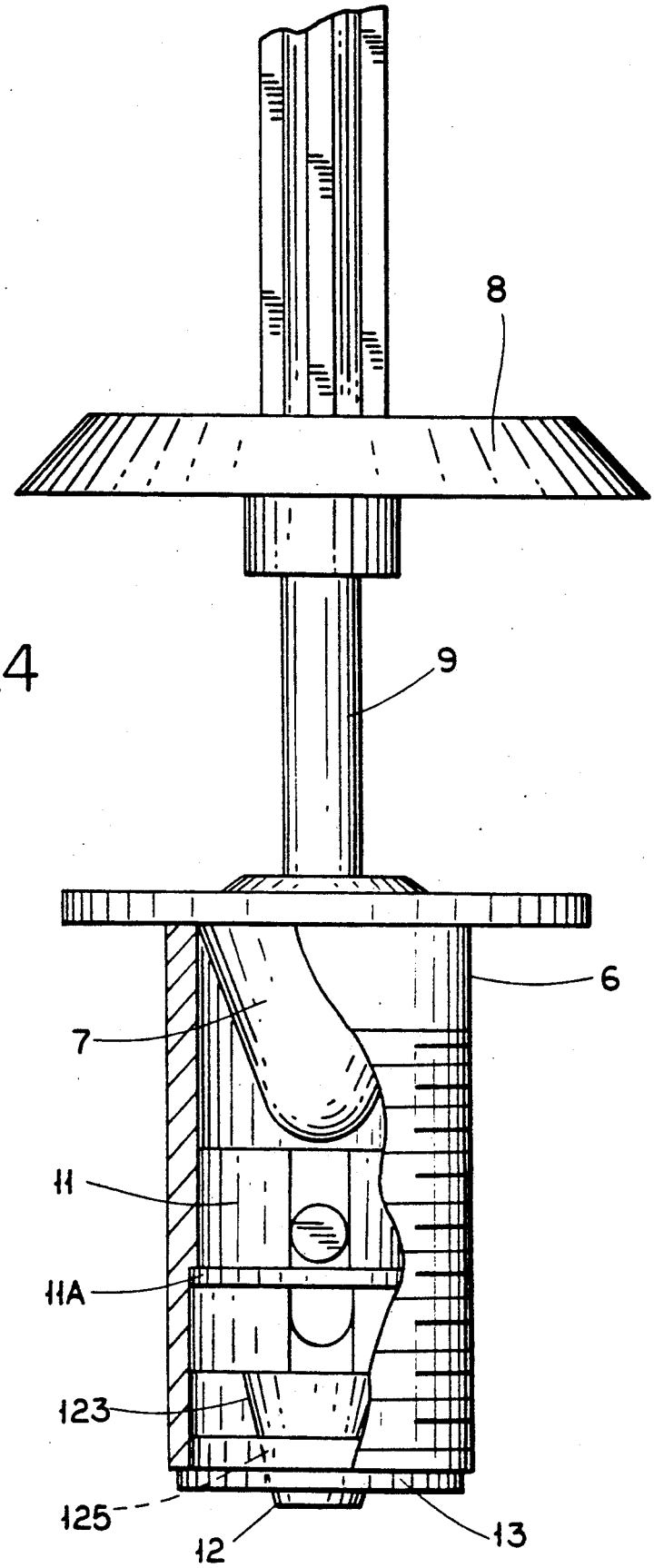
FIG. 24 is an elevation view, partially broken away, of the water inlet valve and a portion of the valve controlling axle shown in FIG. 1.

FIG. 24 also shows the valve base 6, and further shows various components, described hereinafter, which fit therewithin.

Figure 11:
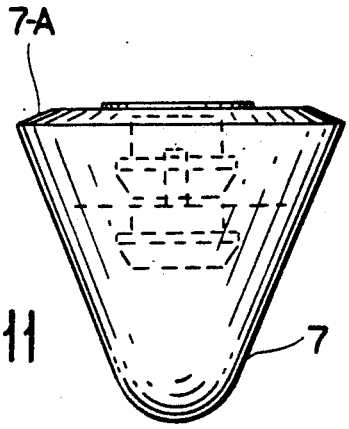
FIG. 11 is a side view of the valve portion shown in FIGS. 9 and 10.
Figure 9:
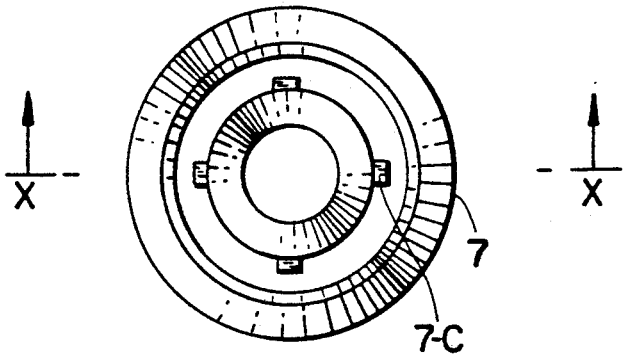
FIG. 9 is an enlarged top plan view of a valve portion shown in FIG. 1.
Figure 12:
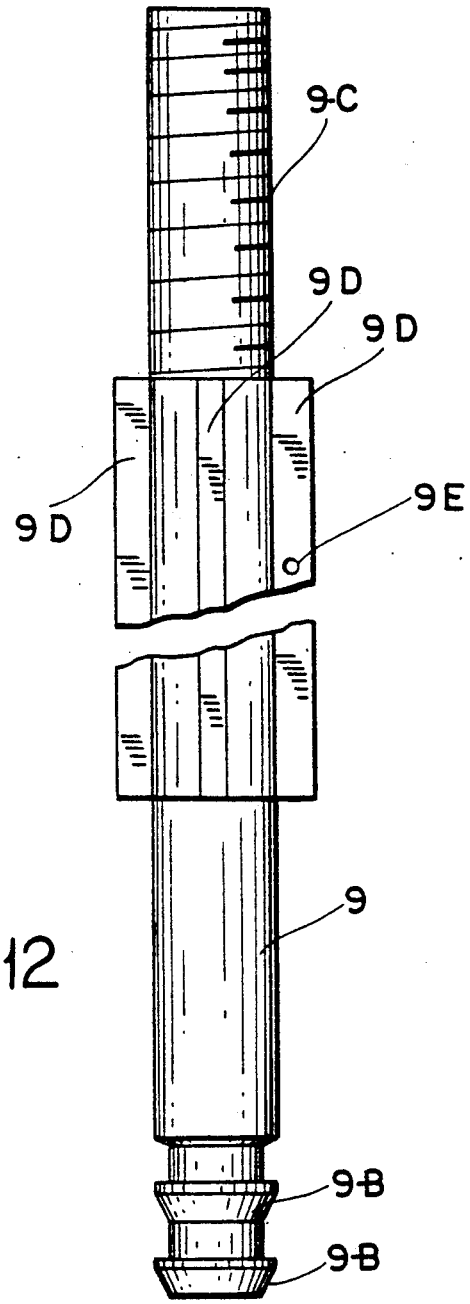
FIG. 12 is an enlarged elevation of a portion of an axle shown in FIG. 1.

The valve 7 (FIGS. 9–11) is a cone-shaped part, converging downwardly, with an uppermost circular end (cone base) 7-A. At the center of its cone base end 7-A, it has a cylindrical cavity with axially successive, correspondingly conical sectors, so as to provide internal rings 7-D for fasteners 9-B (FIG. 12) on one end of the axle 9 when inserted therein. A generally cylindric empty space 7-B extends concentrically about the full circumference of the cone base end 7-A of the valve. It is destined to receive the impact of the water under pressure supplied to the valve and keeps the valve in its downward open position while the toilet tank is filling. Inside this empty space 7-B are four radially protruding stops 7-C (FIG. 9) which perform as fasteners in the stripping operation during the manufacture of this part. Within the empty space 7-B is a portion of the surface of the cone base end 7-A for valve closure in cooperation with the circular ring seat 6-A of the valve base.

Figure 13:
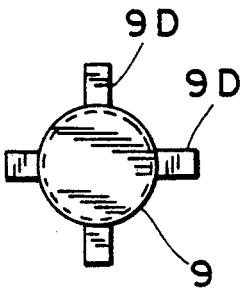
FIG. 13 is a top view of the axle portion shown in FIG. 12.
Figure 14:
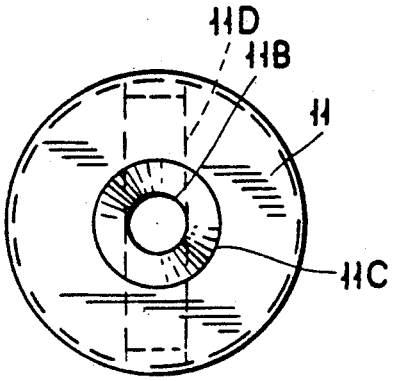
FIG. 14 is an enlarged bottom view of a pressure reducer used within the inlet valve shown in FIG. 1.
Figure 17:
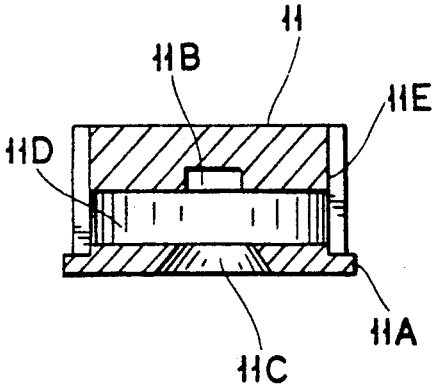
FIG. 17 is a cross-sectional view taken along line 17—17 of FIG. 16.
Figure 15:
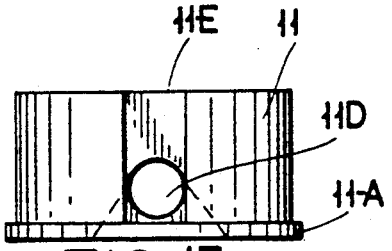
FIG. 15 is a side view of the pressure reducer.
Figure 16:
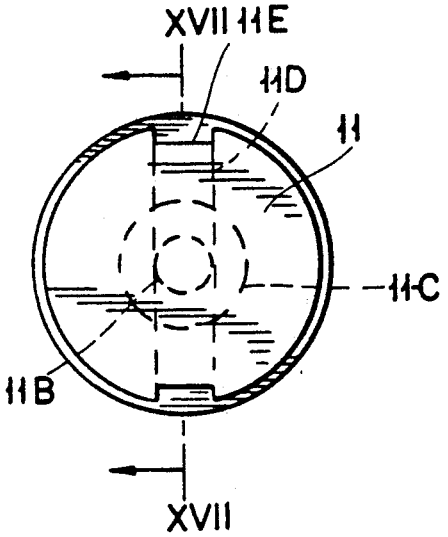
FIG. 16 is a top view of the pressure reducer.
Figure 18:
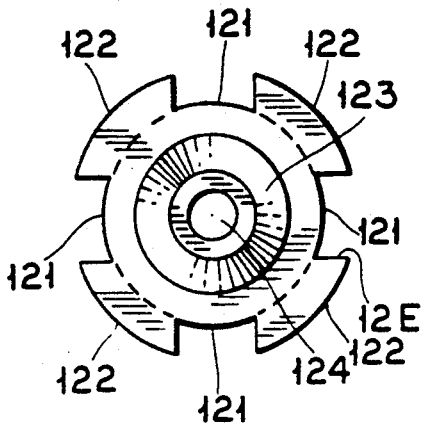
FIG. 18 is an enlarged bottom view of a non-return valve used within the inlet valve shown in FIG. 1.
Figure 21:
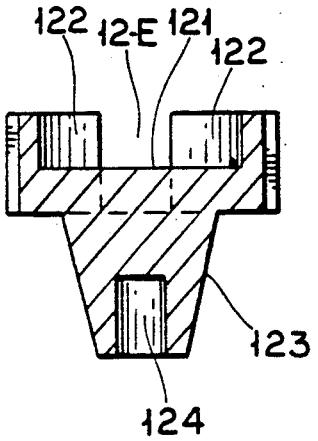
FIG. 21 is a cross-sectional view along line 21—21 of FIG. 20.
Figure 19:
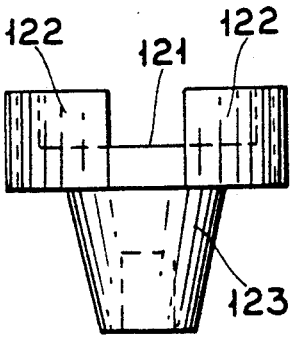
FIG. 19 is a side view of the non-return valve.

The axle 9 (FIGS. 1, 12 and 13) is a bar that, in this embodiment, is threaded along its upper end 9-C, but could be threaded along most of its length. Its lower end has one or more salient rings 9-B that form the fasteners which are pressure-fitted into their corresponding rings 7-D in the valve 7. Disposed along a length of the axle, intermediate its ends, are four diametrically opposed, longitudinally extending ridges 9-D which provide strength reinforcement for the axle. One of the ridges includes a hole 9-E therethrough to which is secured the pulling chain 3B.

Within the tank T (FIG. 1), an umbrella-cap 8 is mounted on a lower portion of the axle 9 in abutment with a lower end of the ridges 9-D. As generally shown in FIG. 1, the cap 8 is a disk having an umbrella-like shape. It has a central hole therethrough so that it can be mounted on the axle 9. Its purpose is to receive and downwardly deflect the water entering the tank from the inlet valve to avoid splashing or spilling of the water from the tank.

The axle floater 10 (FIG. 1) is a cylindrical floater assembly, consisting of an upper cover and a lower main body, like the drainage buoy. A hollow stem 10-C projects from the center of the lower body. This stem has internal threading for attachment to the axle 9.

The pressure reducer 11 (FIGS. 14–17) is a plug which is permanently fixed (FIG. 24) within the valve base 6. It has a cylindrical shape with a projecting ring 11-A at its lower end that abuts against the stop 6-F internally of the valve base 6, thereby positioning the pressure reducer 11 within the valve base. The lower end of the pressure reducer 11 has a vertical, ascending orifice 11-B that does not reach the upper end of the pressure reducer, i.e. it is a blind hole. The lower entrance of the aforementioned orifice is expanded into a conical shape 11-C. Another orifice 11-D extends horizontally and diametrically through the pressure reducer, intersecting the ascending orifice 11-B. The horizontally extending orifice 11-D is open at both of its ends. On the external, cylindrical surface of the pressure reducer, starting at each end of the horizontal orifice 11-D, there is a vertical, ascending channel 11-E which reaches to the top end of the pressure reducer. Water entering the tank through the inlet valve 6 must pass through the various orifices and channels of the pressure reducer. The pressure reducer is thus effective to reduce the water pressure when the inflow pressure is excessively high.

In the mechanism shown in the aforementioned U.S. patent, the pressure reducer is disposed at the lower end of the valve body. In the present improvement of the known mechanism, the pressure reducer 11 is disposed (FIG. 24) inwardly from the lower end of the valve body 6, and a non-return valve 12 and associated water 13 are disposed between the pressure reducer 11 and the lower end of the valve body 6.

The non-return valve 12 (FIGS. 18–21) has the shape of an inverted truncated cone 123, which has, in its lower smaller base, a central, blind orifice 124. The top section of the valve comprises a circular base 121 having a larger diameter than the upper end of the truncated-cone 123. The circular base 121 is surrounded by four equal segments 122 of a cylinder-shaped wall which is higher than the base, and which has four crenel-like spaces 12-E between the wall segments 122.

Figure 23:
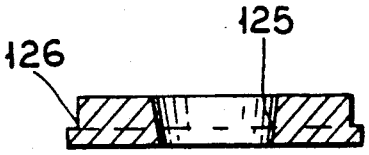
FIG. 23 is a cross-sectional view taken along line 23 of FIG. 22.
Figure 20:
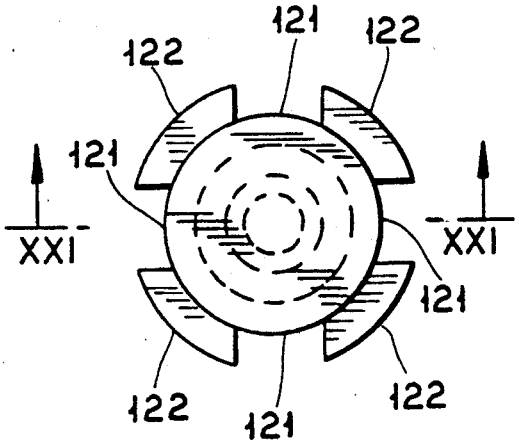
FIG. 20 is a top view of the non-return valve.
Figure 22:
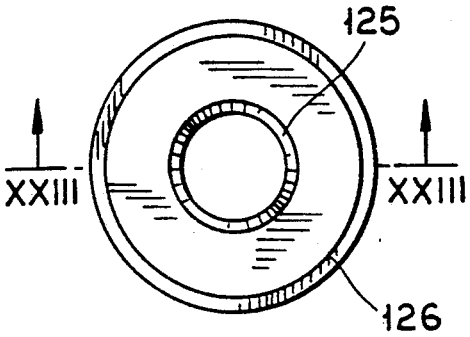
FIG. 22 is an enlarged view of a valve washer used within the inlet valve shown in FIG. 1.

The valve washer 13 (FIGS. 22–23) has a shape defined by two different diameters which produce a perimetrical shoulder 126 which controls the positioning of the washer 13 within the valve base 6 (FIG. 24). The central opening 125 through the washer has the shape of a truncated cone which matches the shape of the dependent truncated cone 123 of the non-return valve.

The non-return valve 12 and the valve washer 13 cooperate to prevent discharge of water from the tank back into the water supply, via the inlet valve 6, in the event of a drop of pressure of the water supply.

Within the valve body 6, as shown in FIG. 24, the non-return valve 12 has a limited free vertical movement from a high position, as illustrated, to a low position (not shown) when the valve 12 moves downwardly away from the fixed pressure reducer 11 towards the washer 13. In the illustrated high position, which occurs when the tank is filling with water, the dependent truncated cone 123 of the non-return valve 12 fits loosely within the central opening 125 of the washer 13 allowing free flow of water into the valve body 6 and past the valve 12. Conversely, in the event of a drop of pressure in the water supply, the non-return valve 12 falls downwardly until the cone 123 fits snugly within the washer opening 125 thereby plugging it.

In normal usage, with the upper end of the valve body 6 plugged by the valve 7, the valve body 6 is filled with water from the water supply. Upon a drop of pressure of the water supply, the water within the valve body 6 tends to drain from the valve body. The water also drains from the blind orifice 124 (FIG. 21) at the bottom of the non-return valve 12 which gives rise to a suction force which tends to force the valve 12 downwardly into the washer 13. Such suction force assists the force of gravity to firmly seat the valve 12 within the washer 13 to securely seat it against downward flow of water.

I claim:

1. Apparatus for filling a toilet tank with water and discharging the water therefrom, comprising:

a valve base for fastening to a tank of a toilet, the valve base having a hollow passage therethrough opening vertically into the toilet tank for supplying water to the toilet tank from an end of the hollow passage when the valve base is fastened to the toilet tank;

a valve plug in the hollow passage for closing said one end to the passage of water therethrough when said valve plug is pulled vertically toward said one end;

a pressure reducer in the hollow passage between said valve plug and the other end of the hollow passage;

an axle connected to the valve plug at one end;

an axle buoy on the opposite end of said axle and being effective to pull said valve plug vertically toward said one end when the toilet tank is full of water;

an umbrella cap about the axle between the ends thereof for deflecting water supplied from said one end of the hollow passage;

a buoy base for fastening to the toilet tank for discharging water therefrom;

a discharge buoy for closing the buoy base under the pressure of water in the toilet tank until pulled from the buoy base, and then floating on the water in the toilet tank back to the buoy base as the water in the toilet tank is discharged therefrom;

a first flexible pulling means connected to one end to the discharge buoy;

a second flexible pulling means connected at one end to the axle; and a lever connected to the opposite ends of the first and second flexible pulling means for moving by a command lever on the outside of the toilet tank, whereby to pull the discharge buoy from the base and tilt the axle, the valve plug then allowing the supply of water from the hollow passage.

2. In an apparatus for filling a toilet tank with water, said apparatus having a valve base for fastening to the toilet tank, the valve base having a hollow passage therethrough opening vertically into the toilet tank at one end for supplying water to the toilet tank from the one end of the hollow passage when the valve base is fastened to the toilet tank, a non-return value assembly improvement, comprising:

a non-return valve washer having an aperture centrally therethrough across the hollow passage too the valve base; and a generally conical non-return valve having one end and, at an opposite end, a truncated apex with an axial, blind orifice extending into the non-return valve from the truncated apex, cross sections of the non-return valve transverse to its cone axis at the opposite end being complementary to the aperture of the non-return valve washer, the one end of the non-return valve being axially guided in the hollow passage valve base above the non-return valve washer for vertical movement toward and away from the non-return valve washer and circumferentially configured relative thereto for passing water therebetween, whereby the pressure of water for filling the toilet tank pushes the non-return valve vertically from the non-return valve washer unless the water returns, whereupon gravity and suction about the blind orifice force the opposite end into the aperture for stopping such return.

* * * * *